US006138825A

United States Patent [19]

Summerlin

[11] Patent Number: 6,138,825

[45] Date of Patent: Oct. 31, 2000

[54] GOLF CLUB MANAGER

[76] Inventor: Ray R. Summerlin, 5180 S.W. 186th Ave., Ft. Lauderdale, Fla. 33332

[21] Appl. No.: 09/347,570

[22] Filed: Jul. 6, 1999

[51] Int. Cl.[7] ..... A63B 55/00; A63B 57/00

[52] U.S. Cl. ..... 206/315.6; 206/315.3

[58] Field of Search ..... 206/315.2–315.6

[56] References Cited

U.S. PATENT DOCUMENTS

| | | | |
|---|---|---|---|
| 1,849,610 | 3/1932 | Boyce | 206/315.6 |
| 2,551,780 | 5/1951 | Wood | 206/315.6 X |
| 3,331,419 | 7/1967 | Bencriscutto | 206/315.6 |
| 3,674,072 | 7/1972 | Shuto | 206/315.6 |
| 4,194,547 | 3/1980 | Sidor et al. | 206/315.6 |
| 4,208,227 | 6/1980 | Cowan | 206/315.6 |
| 4,332,283 | 6/1982 | Rader | 206/315.6 |
| 4,340,102 | 7/1982 | Isabel | 206/315.6 |
| 5,135,107 | 8/1992 | Ingraham | 206/315.6 |
| 5,226,533 | 7/1993 | Antonious | 206/315.6 |
| 5,383,555 | 1/1995 | Weinmeier | 206/315.6 |
| 5,505,300 | 4/1996 | Joh | 206/315.6 |
| 5,617,951 | 4/1997 | Wick | 206/315.6 |
| 5,620,091 | 4/1997 | Larson | 206/315.6 |
| 5,671,843 | 9/1997 | Sutter | 206/315.6 |
| 5,775,513 | 7/1998 | Anthony | 206/315.6 X |
| 5,816,397 | 10/1998 | Pratt | 206/315.6 |
| 5,950,825 | 9/1999 | Shin | 206/315.6 |

FOREIGN PATENT DOCUMENTS

| | | | |
|---|---|---|---|
| 207317 | 11/1923 | United Kingdom | 206/315.5 |

*Primary Examiner*—Sue A. Weaver
*Attorney, Agent, or Firm*—Oltman, Flynn & Kubler

[57] ABSTRACT

This invention is a golf club manager having an apertured base received inside a golf bag near the top and a thin annular side wall extending up from the periphery of the base. The top edge of the side wall is circumferentially tapered from a high on one side to a low on the opposite side, and it has a plurality of recesses in succession circumferentially which are radially aligned with individual openings in the base. These recesses hold the heads of individual golf clubs facing radially outward, and the shafts of these clubs extend down through corresponding openings in the base of the manager. A strip of rubber-like material covers the top edge of the side wall for engaging the heads of clubs from below. The side wall is formed with a plurality of circumferentially spaced, vertically cantilevered hooks with teeth that permit its slidable insertion down into the upper end of the golf bag but prevent it from being accidentally dislodged from the position to which it has been inserted.

3 Claims, 3 Drawing Sheets

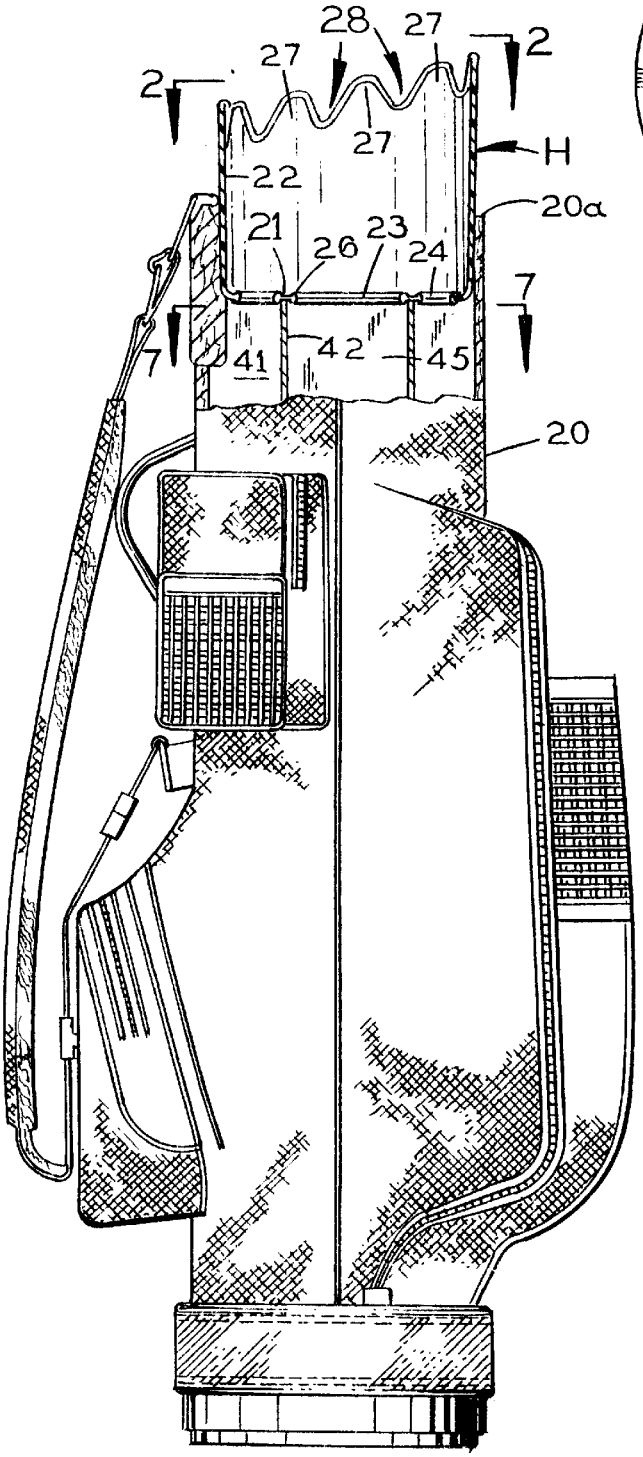
FIG. 1
FIG. 2
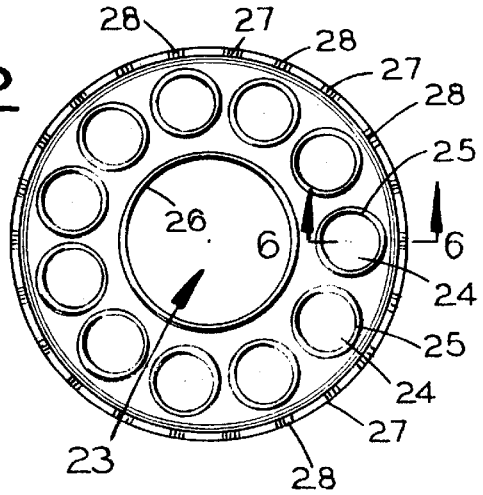
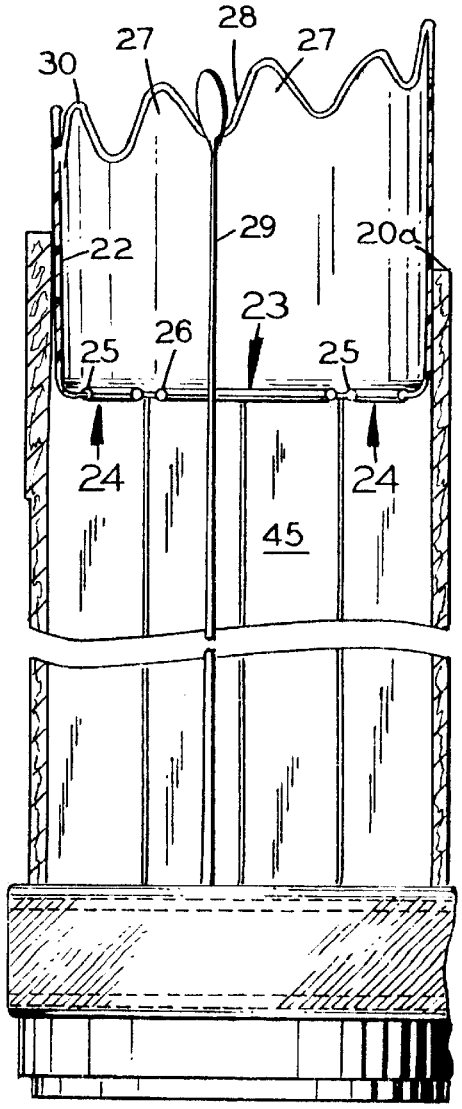
FIG. 3

GOLF CLUB MANAGER

BACKGROUND OF THE INVENTION

1. Field of the Invention

This invention relates to a golf club manager for use on a golf bag to hold the clubs securely in predetermined positions separated from one another in all the positions the golf bag might be put in during the course of the game, whether upright or horizontal or in between.

2. Prior Art

Various rather elaborate arrangements for this purpose have been disclosed heretofore in U.S. patents.

In Antonious U.S. Pat. No. 5,226,553 and Joh U.S. Pat. No. 5,505,300 a club holder keeps the club shafts separated but does not hold the individual club heads securely.

In Weinmeier U.S. Pat. No. 5,383,555 a club holderholds the heads of irons individually but does not separate their shafts. In Pratt U.S. Pat. No. 5,816,397 a club holder holds the heads of irons individually and, except for one, receives their shafts in pairs.

Ingraham U.S. Pat. No. 5,135,107, Pratt U.S. Pat. No. 5,816,397, Beniscrutto U.S. Pat. No. 3,331,419 and Isabel U.S. Pat. No. 4,340,102 show club holderss that hold the heads of irons individually and keep their shafts separated.

Larson U.S. Pat. No. 5,620,091 discloses a golf club holderhaving slots at the top for holding the heads of individual clubs and intended for use with a golf bag having sectional struts that provide rectilinear row and column bracing and division of the interior of the golf bag into multiple club groupings.

Cowan U.S. Pat. No. 4,208,227 discloses a golf club holder which is slotted at the top to hold the heads of individual clubs and is dependent upon its being clamped to the outside of a golf bag to develop compressive stresses in the manager at these slots at the radially inward side and tensile stresses at the radially outward side.

BRIEF SUMMARY OF THE INVENTION

The present invention is directed to a novel, simplified, light weight golf club manager which is adapted for snug reception inside the upper end of a golf The manager of the present invention has a relatively thin, flat base for snug reception inside a golf bag a short distance below its upper end and an upstanding side wall that extends up from the base and has a curvature conforming to the inside of the golf bag. The manager side wall projects above the top of the golf bag and presents a series of recesses or slots at its top edge in succession circumferentially for securely holding the heads of individual clubs, whether the golf bag is upright or laid on its side. The base of the club manager has openings for receiving the shafts of clubs whose heads are in corresponding recesses or slots at the top edge of its side wall. The base segregates the shafts of the several clubs and protects them against damaging or interfering with one another, even if the golf bag is handled carelessly. The recesses in the top edge of the manager are radially aligned individually with corresponding openings in the base of the manager so that the club heads are held facing outward. Preferably, the top edge of the manager is tapered circumferentially from a high on one side of the bag to a low on the opposite side. Because of this circumferential taper the recesses or slots at the top edge are at different levels and are arranged in a predetermined sequence circumferentially of the golf bag, corresponding to the clubs they receive, to make it easier for a player to locate any particular club for the next shot and to notice whether a club is missing and identify it.

A principal object of this invention is to provide a novel golf club manager that securely holds the heads of several clubs in predetermined individual positions above the top edge of a golf bag and keeps the shafts of these clubs separated from each other inside the golf bag.

Another object of the invention is to provide, for use on a golf bag, a novel golf club manager of simplified, light weight construction that does not tend to make the golf bag top-heavy.

Further objects and advantages of the invention will be apparent from the following detailed description of a presently preferred embodiment illustrated in the accompanying drawings.

BRIEF DESCRIPTION OF THE DRAWINGS

FIG. 1 shows in side elevation a golf bag of conventional design with its upper end in section and receiving a club manager in accordance with a preferred embodiment of the present invention;

FIG. 2 is a top plan view of the club manager, taken from the line 2—2 in FIG. 1;

FIG. 3 is a view generally similar to FIG. 1 showing a #2 iron in the club manager with its shaft extending down into the golf bag;

DETAILED DESCRIPTION OF THE PREFERRED EMBODIMENT

Figure 4:
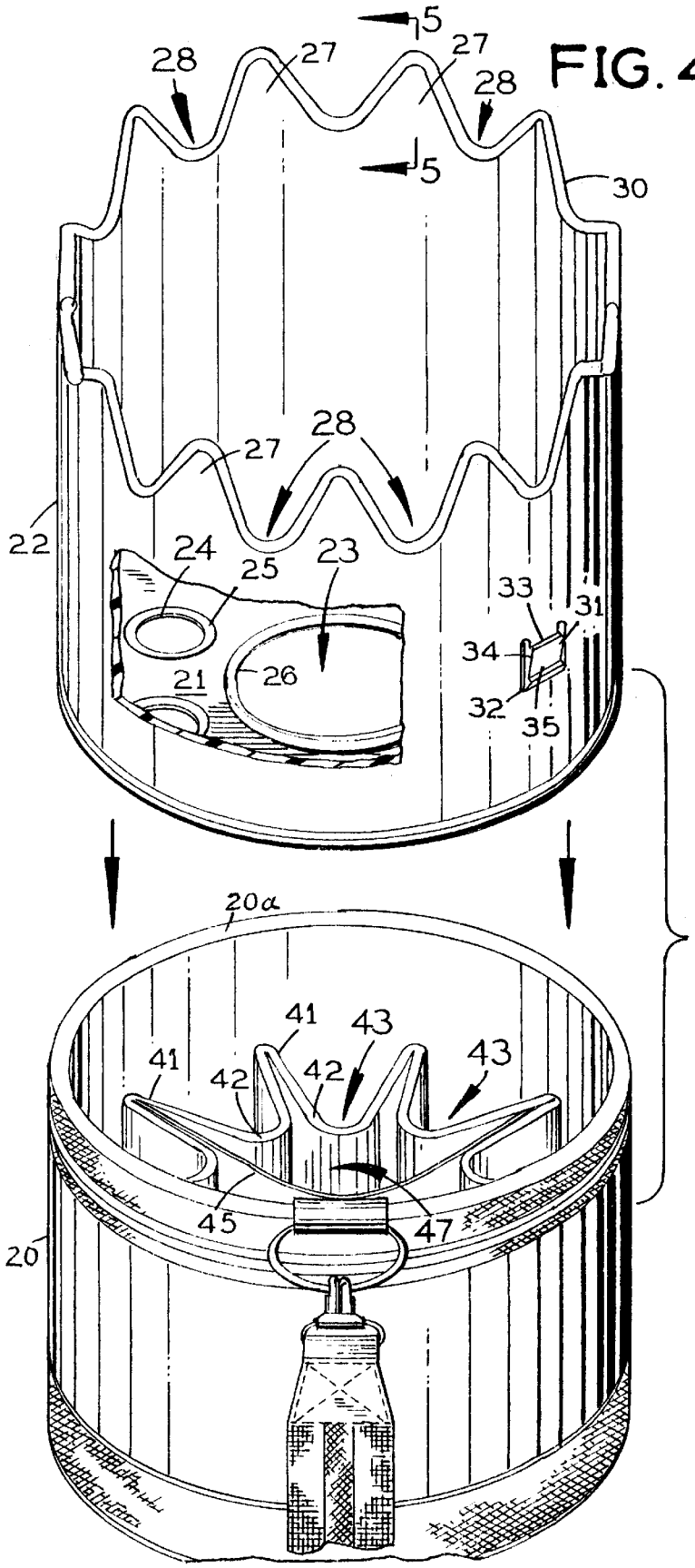
FIG. 4 is an exploded perspective view of the present club manager (with part of its side wall broken away to reveal its base) removed from the golf bag and showing in the bag a lower insert for receiving the club shafts individually.

FIG. 1 shows the club manager H of the present invention in its operative position in the upper end of a golf bag 20. The club manager has a thin, generally flat, apertured base 21 which in this position extends horizontally across the interior of the golf bag a short distance below its top edge 20*a*, and a thin, upstanding, annular side wall 22 which extends up from the periphery of base 21and snugly engages the inside of the golf bag. The base and side wall of the manager are made of a suitable plastic. Although thin, the upstanding side wall 22 is strong enough to support the weight of a set of golf clubs without buckling or otherwise deforming significantly from the shape shown in FIGS. 1, 3, 4 and 8.

The base 21 of the manager has a relatively large central opening 23 of circular outline bounded by an opening 26 and a series of smaller circular openings 24 closely spaced evenly in succession circumferentially around the central opening. In the embodiment shown there are eleven of the smaller openings 24, each bounded by an O-ring 25 (FIG. 6) of rubber or suitable plastic held in the manager base 21. Each of these O-rings acts a protective cushion for an individual golf club shaft that extends down through that opening, as shown in FIG. 3 for the shaft of the iron 29.

The upstanding side wall 22 of the present golf club manager is rounded circumferentially to conform closely to the inside of the golf bag 20 at the top. Side wall 22 projects up a few inches beyond the top edge 20*a* of the golf bag, as shown in FIG. 1, and terminates in a circumferentially tapered top edge having an undulating, wavy or sinuous configuration with alternate peaks or projections 27 and valleys 28 between the projections that define open-topped slots or recesses for receiving and holding the heads of individual clubs. As shown in FIG. 2, each recess or slot 28 along the top edge of the club manager is radially aligned with a corresponding opening 24 in the manager base 21.

Figure 5:
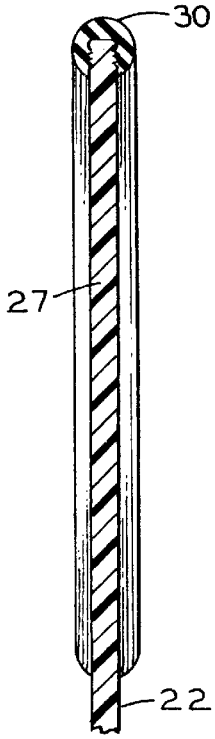
FIG. 5 is a vertical cross-section taken along the line 5—5 in FIG. 4 through the upper portion of the present club manager.

As best seen in FIGS. 4 and 5, a cushioning strip 30 of rubber or suitable plastic covers the undulating top edge of the manager side wall 22 along its entire circumferential extent. Preferably, the material of strip 30 has a sufficiently high coefficient of friction that the strip effectively resists the tendency of club heads to slip out of the recesses or slots 28 if the golf bag is dropped or handled carelessly.

Figure 9:
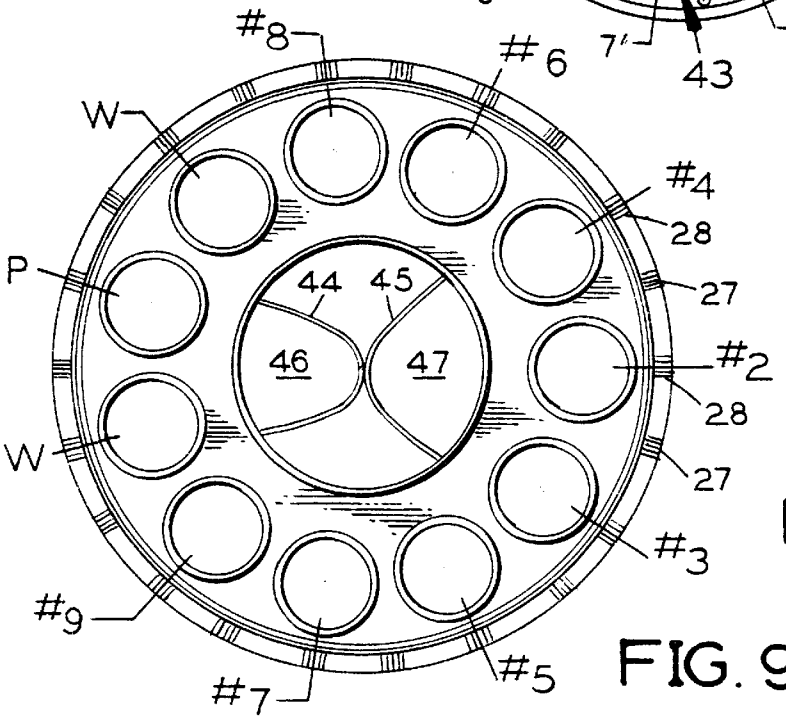
FIG. 9 is a top plan view of the present club manager and the portion of the lower insert in the golf bag that is visible below the base of the club manager.

The height of side wall 22 of the manager progresses gradually from a high at the right side in FIG. 3 to a low at the left side. The slots or recesses 28 on the higher side of the manager are for the irons, and three slots or recesses at the lower side are for two woods and a putter, as shown by the number and letter designations in FIG. 9. The irons should be arranged in the manager in a sequence corresponding to their numbers, i.e., in the sequence indicated in FIG. 9, with the #2 iron in the highest recess or slot 28, the #3 iron in the next-to-the-highest recess, and so on. The recesses or slots 28 for the odd-numbered irons are spaced apart in succession away from the recess or slot for the #2 iron in one circumferential direction, and the recesses or slots for the even-numbered irons are spaced apart in succession in the opposite circumferential direction. The location of each the recess or slot 28 tells the player which club belongs there, so the player can tell immediately if a club is missing and which one it is.

With this construction of the present club manager, the shafts of a set of golf clubs have their respective shafts extending down individually through corresponding openings 24 in the base of the manager and their heads extending radially outward closely across the respective recesses or slots 28 in the top edge of the manager. Consequently, the heads of these clubs do not interfere with each other, and each club can be readily identified. Also, any woods that are received in the central opening 23 in the base of the manager will be readily visible and accessible to the player because the other clubs are held with their heads projecting outward. The manager as thus described and shown in the accompanying drawings keeps the clubs in place not only when the golf bag is upright but also if the bag is dropped or laid down on its side.

Figure 10:
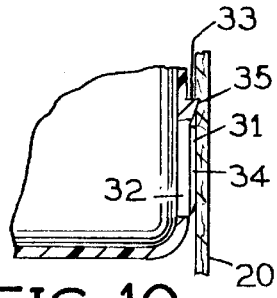
FIG. 10 is a vertical cross-section taken along the line 10—10 in FIG. 6 at one of the serrated hooks on the present club manager for attaching it to the inside of the golf bag.

The club manager of the present invention can be made a permanent part of a newly manufactured golf bag or it can be an insert for slidable insertion into the mouth of an existing golf bag. In the latter case, vertically cantilevered, serrated hooks 31 (FIGS. 4, 6 and 10) can be provided on the outside of the manager for biting engagement with the inside of the golf bag to hold the club manager in place on the golf bag, as shown in FIG. 10.

Figure 6:
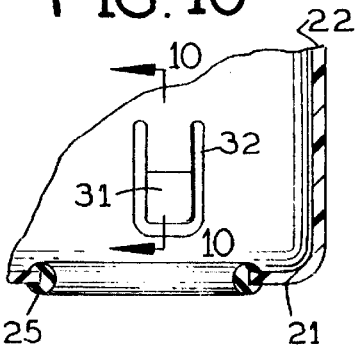
FIG. 6 is a vertical cross-section taken along the line 6—6 in FIG. 2 at the base of the present club manager.
Figure 8:
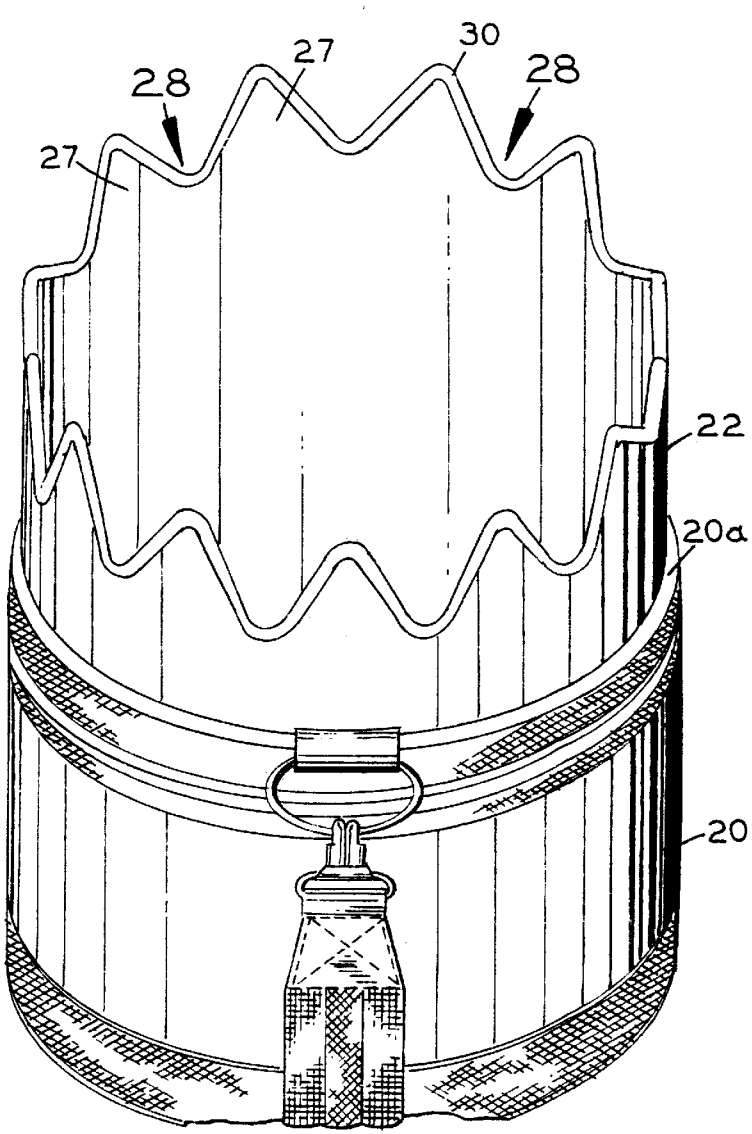
FIG. 8 is a perspective view of the present club manager positioned in the upper end of the golf bag.

As shown in FIG. 6, each hook 31 is integrally joined at its upper end to the main body of the side wall 22 of the manager and is separated from it along the sides and bottom by a right-angled U-shaped opening 32. Each hook 31 presents an outwardly-facing tooth having an upwardly-facing horizontal shoulder 33 at the top and an inwardly tapered outer face 34 which extends down from its juncture with the shoulder at a sharp horizontal edge 35. Preferably, there are three such hooks 31 at 120 degree intervals circumferentially of the club manager. The tapered faces 34 of the hooks enable the manager to be inserted down into the upper end of the golf bag, but the sharp edges 35 on the hooks bite into the inside of the golf bag to keep the manager in place and prevent it from being accidentally dislodged from the position to which it has been inserted.

Alternatively, various other types of fasteners may be provided for fastening the present manager securely to the golf bag in the position shown in FIG. 1.

An optional feature of the present invention is a fluted lower insert 40 that is snugly received in the golf bag 20 directly below the manager H and extends down to the bottom of the golf bag.

Figure 7:
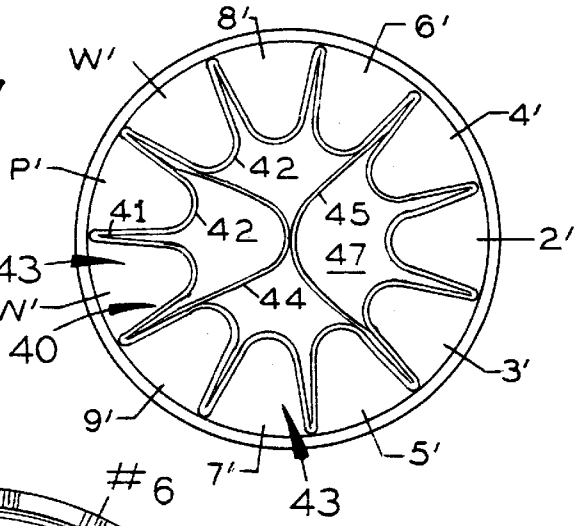
FIG. 7 is a horizontal cross-section taken along the line 7—7 in FIG. 1 at the upper end of the lower insert just below the base of the present club manager.

Viewed from above (FIG. 7), the lower insert has the shape of an eleven-pointed asterisk or star. It has eleven circumferentially spaced folds 41 projecting radially out from rounded inner segments 42 that connect successive folds. The outer tips of folds 41 engage the inside of the golf bag. Folds 41 and connecting inner segments 42 together define eleven vertically elongated recesses 43 inside the golf bag below manager H which are aligned with individual openings 24 in the base 21 of the manager.

The lower insert also has a vertically elongated first separator or divider 44 of rounded V-shape viewed from above (FIG. 7), with the opposite legs of the V sandwiched in two folds 41 of the lower insert which are separated circumferentially by a single fold 41,so that these folds and the separator define a first interior recess 46 at one side of the lower insert. A second vertically elongated separator or divider 45 of generally similar configuration abuts against the first separator 44 along the centerline of the golf bag. The opposite legs of separator 45 are sandwiched in two folds 41 of the lower insert which are two folds apart circumferentially, so that these folds and the second separator define a larger second interior recess 47 extending down inside the golf bag parallel to and diametrically opposite the first recess 46. These recesses receive the shafts of woods passing down through the central opening 23 in base 21 of manager H.

With this arrangement, the lower insert keeps the shafts of the golf clubs separated along the entire vertical extent of the golf bag.

The present invention may be embodied in other specific forms without departing from its essential characteristics, as defined in the appended claims.

I claim:

1. A golf club manager for use with a golf bag comprising:

a base shaped and dimensioned to be received in the upper end of a golf bag with the periphery of said base extending circumferentially around the inside of the golf bag near the top, said base having a plurality of openings therein spaced apart in succession circumferentially for receiving individual shafts of golf clubs;

and a thin, circumferentially rounded, side wall extending up from substantially the entire periphery of said base for engagement with the inside of the golf bag around substantially it entire periphery at the top, said side wall having a wavy top edge spaced above said base and presenting a plurality of open-topped recesses in succession around substantially its entire circumference, said recesses having predetermined positions individually with respect to corresponding openings in said base to hold individually the heads of clubs whose shafts are received in said openings in the base, said wavy top edge of said side wall being tapered in opposite directions circumferentially from a high on one side of the golf bag to a low on the opposite side and providing said recesses at successively lower individual levels above the top of the bag in each direction circumferentially away from said high to thereby present preselected circumferential locations at different levels for individual clubs.

2. A manager according to claim 1, and further comprising a plurality of hooks on the outside of said side wall at circumferentially spaced locations, each of said hooks having at least one outwardly facing tooth for biting engagement with the inside of the golf bag.

3. A manager according to claim 2, wherein each of said hooks has an upwardly-facing shoulder and an inwardly and downwardly inclined outer face extending down from said shoulder at a sharp corner of the tooth.

* * * * *